US009827605B2

(12) United States Patent
Emura et al.

(10) Patent No.: US 9,827,605 B2
(45) Date of Patent: Nov. 28, 2017

(54) TI—MO ALLOY AND METHOD FOR PRODUCING THE SAME

(75) Inventors: Satoshi Emura, Ibaraki (JP); Koichi Tsuchiya, Ibaraki (JP)

(73) Assignee: NATIONAL INSTITUTE FOR MATERIALS SCIENCE, Ibaraki (JP)

( * ) Notice: Subject to any disclaimer, the term of this patent is extended or adjusted under 35 U.S.C. 154(b) by 777 days.

(21) Appl. No.: 14/000,466

(22) PCT Filed: Feb. 23, 2012

(86) PCT No.: PCT/JP2012/054412

§ 371 (c)(1),
(2), (4) Date: Oct. 3, 2013

(87) PCT Pub. No.: WO2012/115187

PCT Pub. Date: Aug. 30, 2012

(65) Prior Publication Data

US 2014/0014242 A1 Jan. 16, 2014

(30) Foreign Application Priority Data

Feb. 23, 2011 (JP) ..... 2011-036790

(51) Int. Cl.

| | |
|---|---|
| ***B21C 37/04*** | (2006.01) |
| ***C22C 14/00*** | (2006.01) |
| ***C22F 1/18*** | (2006.01) |

(52) U.S. Cl.

CPC ..... *B21C 37/045* (2013.01); *C22C 14/00* (2013.01); *C22F 1/183* (2013.01)

(58) Field of Classification Search

CPC ..... C22C 14/00; C22F 1/183; B21C 37/045
See application file for complete search history.

(56) References Cited

U.S. PATENT DOCUMENTS

2004/0241037 A1* 12/2004 Wu ..... 420/421
2005/0257864 A1* 11/2005 Marquardt et al. ..... 148/671

FOREIGN PATENT DOCUMENTS

CA 2 597 251 8/2006
JP 59-56554 4/1984

(Continued)

OTHER PUBLICATIONS

S. Otani et al., "Isothermal Transformation of Ti—Mo Binary β-Alloy", Journal of the Japan Institute of Metals, vol. 35, pp. 92-97, 1971 (with English translation).

(Continued)

*Primary Examiner* — Rebecca Lee
(74) *Attorney, Agent, or Firm* — Wenderoth, Lind & Ponack, L.L.P.

(57) ABSTRACT

A task of the present invention is to provide a Ti—Mo alloy material which can be improved in the yield stress at room temperature by the precipitation of an aged omega phase in the Ti—Mo alloy while maintaining large ductility at room temperature, and a method for producing the same.

Provided is a Ti—Mo alloy collectively having an Mo content of 10 to 20 mass %, wherein the Ti—Mo alloy has a winding belt-like or swirly segregation portion having a width of 10 to 20 μm in the plane of a backscattered electron image (BEI) or an energy dispersive X-ray spectroscopy (EDS) image of the Ti—Mo alloy, as examined under a scanning electron microscope, in which Mo content is larger than the collective Mo content of the Ti—Mo alloy. When generally observing the entire plane examined, a segregation structure in a swirly form can be observed.

Further, provided is the Ti—Mo alloy which has been subjected to aging treatment so that an aged omega phase is precipitated along the segregation portion. When generally (Continued)

observing the entire plane examined, an aged omega phase structure in a swirly form can be observed.

1 Claim, 13 Drawing Sheets

(56) References Cited

FOREIGN PATENT DOCUMENTS

| | | | | |
|---|---|---|---|---|
| JP | 63241150 A | * | 10/1988 | ..... C22F 1/18 |
| JP | 2008-500458 | | 1/2008 | |
| JP | 2008-531843 | | 8/2008 | |
| WO | 2005/113847 | | 12/2005 | |

OTHER PUBLICATIONS

H. Matsumoto et al., "Study on Initial Stages of Formation and Growth of Aged ω-Phase Crystals in a Ti-15 mass%Mo Alloy Using an Analytical Electron Microscope", Journal of Japan Institute of Metals, vol. 67, No. 11, pp. 635-642, 2003 (with English translation).

International Search Report dated May 22, 2012 in International (PCT) Application No. PCT/JP2012/054412.

X.H. Min et al.: "Effects of Fe addition on tensile deformation mode and crevice corrosion resistance in Ti—15Mo alloy", Materials Science and Engineering A, 527(10-11), pp. 2693-2701 (2010).

X.H. Min et al.: "Microstructure, tensile deformation mode and crevice corrosion resistance in Ti—10Mo—xFe alloys", Materials Science and Engineering A, 527(21-22), pp. 5499-5506 (2010).

D. Mareci et al.: "Effect of Mo content on electrochemical behavior of TiMo alloys for dental applications", Materials and Corrosion, 61(10), pp. 829-837(2010).

A. Gysler et al.: "Deformation behavior of age-hardened Ti—Mo alloys", Acta Metallurgica, 22(7), pp. 901-909 (1974).

V.R. Jablokov et al.: "The Application of Ti—15Mo Beta Titanium Alloy on High Strength Structural Orthopaedic Applications", Journal of ASTM International, 2(8), pp. 83-100(2005).

* cited by examiner

Fig. 1
(a)
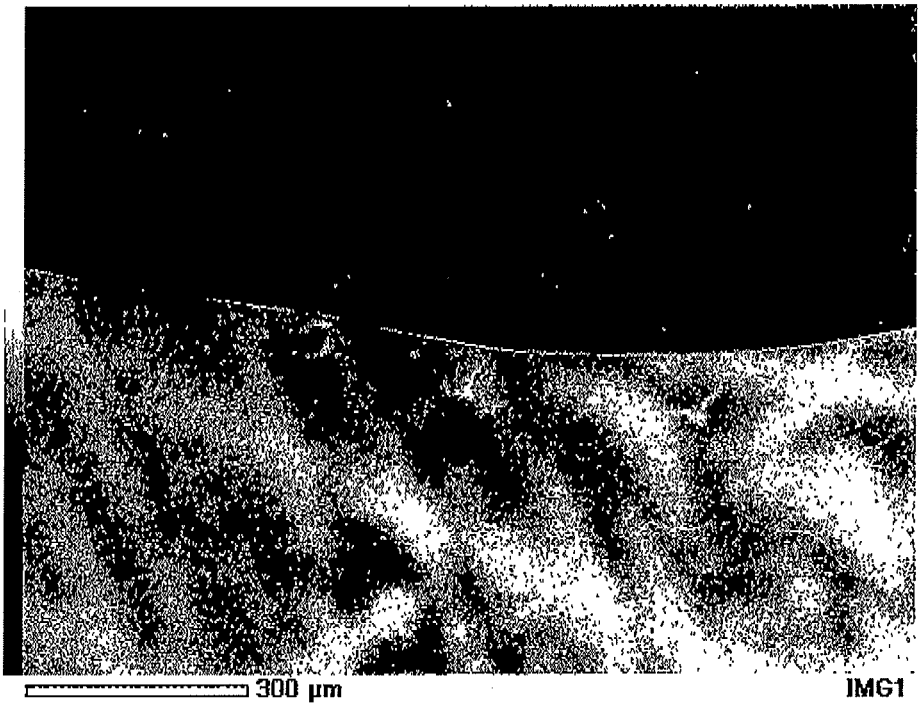
(b)
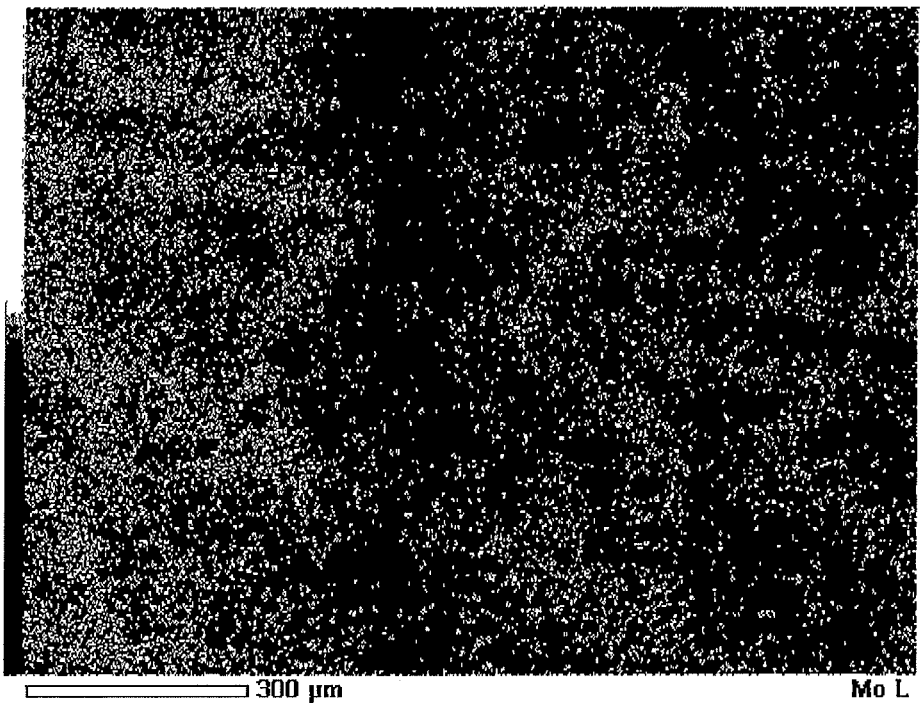

Fig. 3
(a)
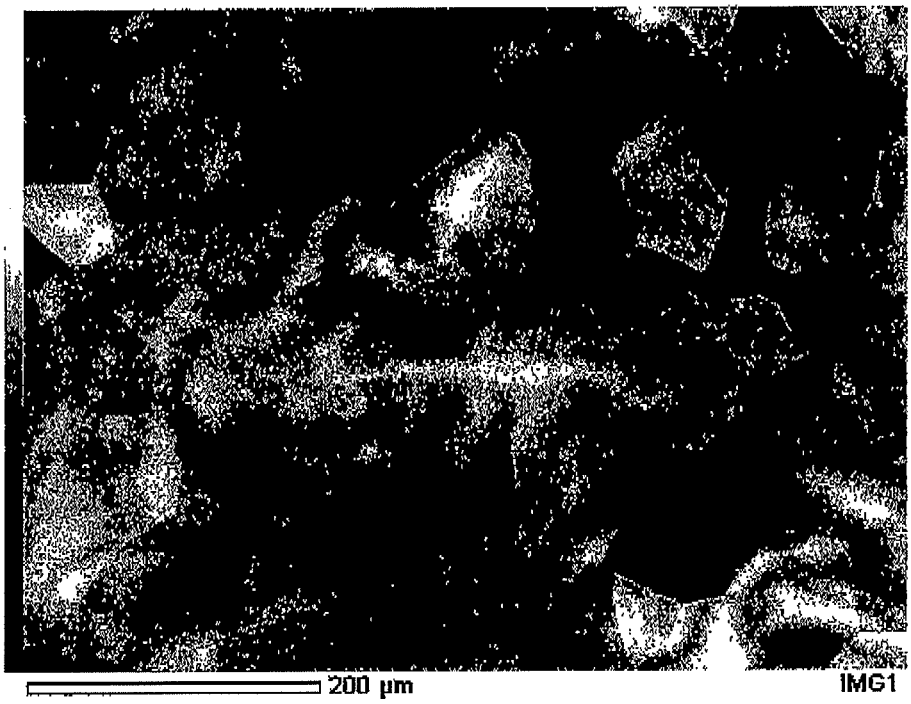
(b)
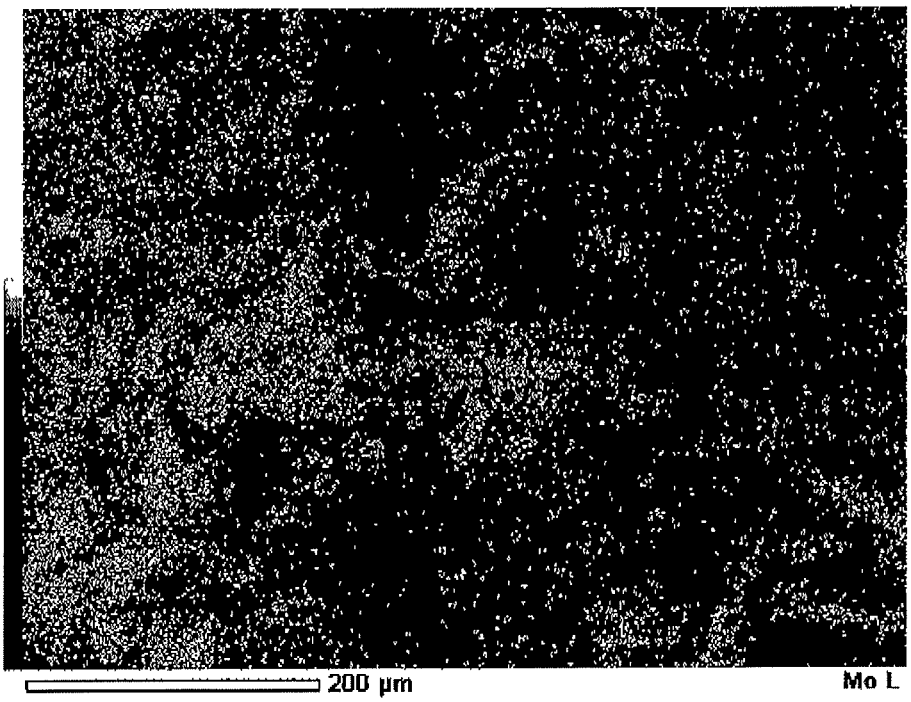

Fig. 4
(a)
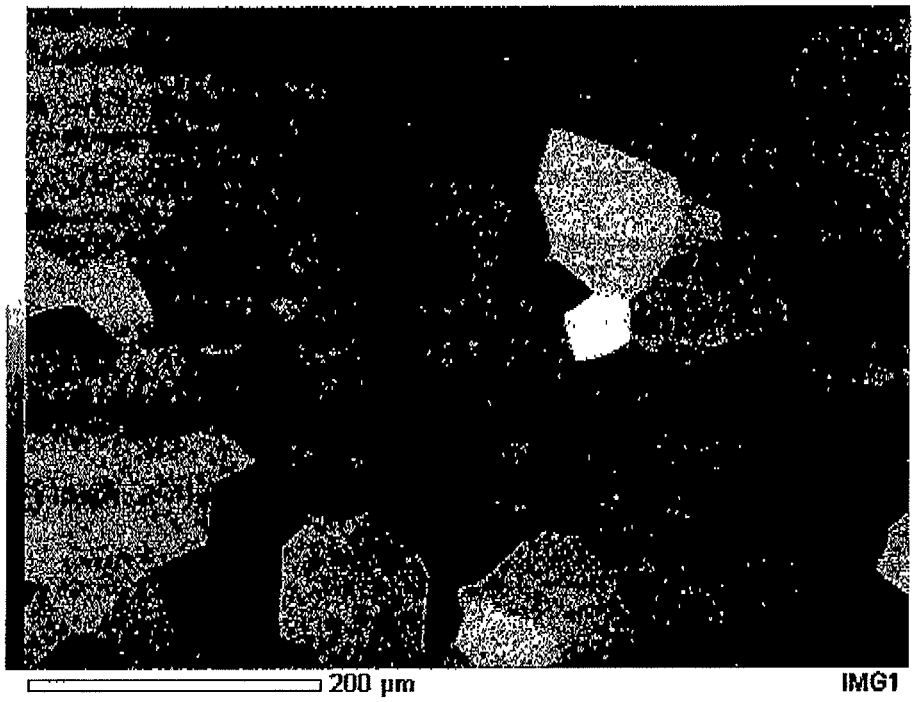
(b)
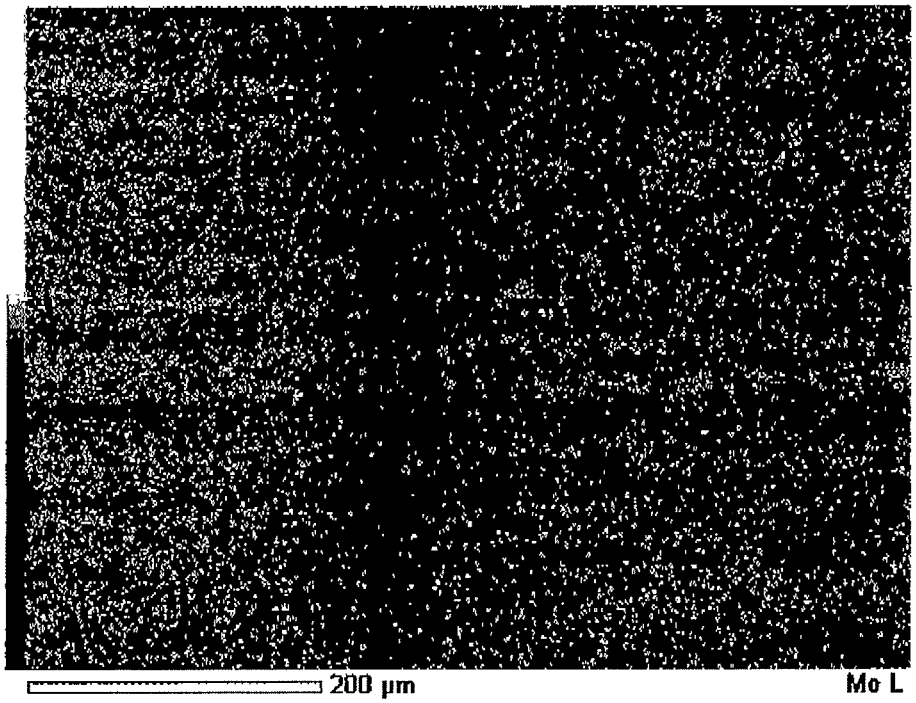

Fig. 5

PRODUCTION PROCESS IN EXAMPLE 1

Ti-12 mass% Mo ALLOY INGOT PRODUCED BY COLD CRUCIBLE LEVITATION MELTING (69 mmΦ)

↓

HOT FORGING AT 1,000°C INTO 40 mm SQUARE

↓

GROOVED-ROLL ROLLING AT 1,000°C INTO 11.8 mm SQUARE

↓

SOLUTION HEAT TREATMENT AT 800°C FOR 1 HOUR, FOLLOWED BY WATER COOLING

PRODUCTION PROCESS IN COMPARATIVE EXAMPLE 1

Ti-12 mass% Mo ALLOY INGOT PRODUCED BY COLD CRUCIBLE LEVITATION MELTING (69 mmΦ)

↓

HOT FORGING AT 1,200°C INTO 40 mm SQUARE

↓

GROOVED-ROLL ROLLING AT 1,200°C INTO 17.5 mm SQUARE

↓

RETENTION AT 1,200°C FOR 3 HOURS

↓

REMOVING OXIDE LAYER ON THE MATERIAL SURFACE BY ABRASION

↓

GROOVED-ROLL ROLLING AT ROOM TEMPERATURE INTO 11.8 mm SQUARE

↓

SOLUTION HEAT TREATMENT AT 800°C, FOR 1 HOUR, FOLLOWED BY WATER COOLING

Fig. 6
(a)
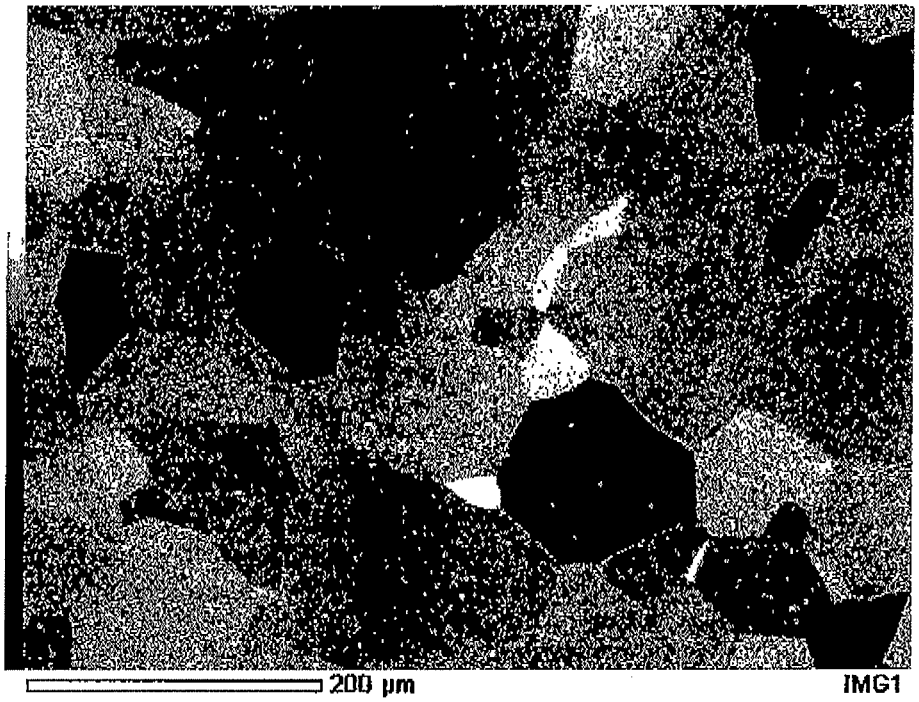
(b)
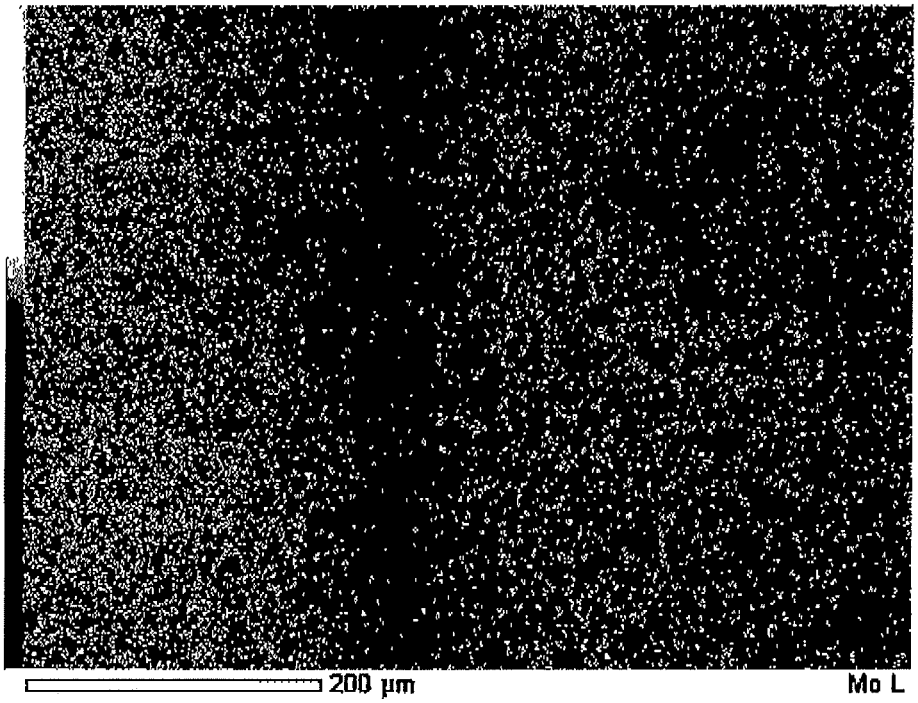

Fig. 11
(a)
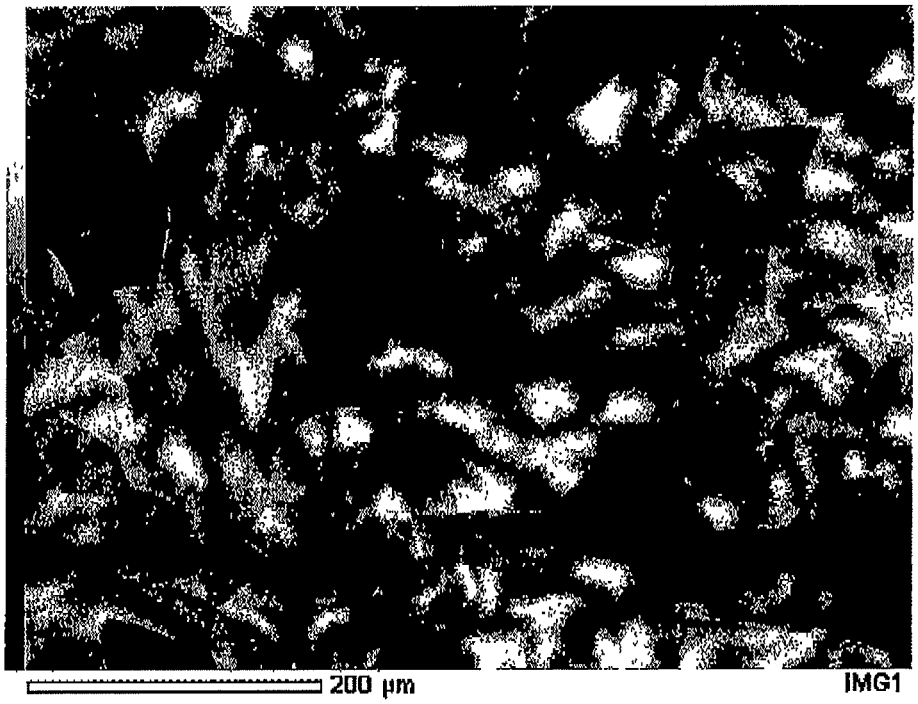
(b)
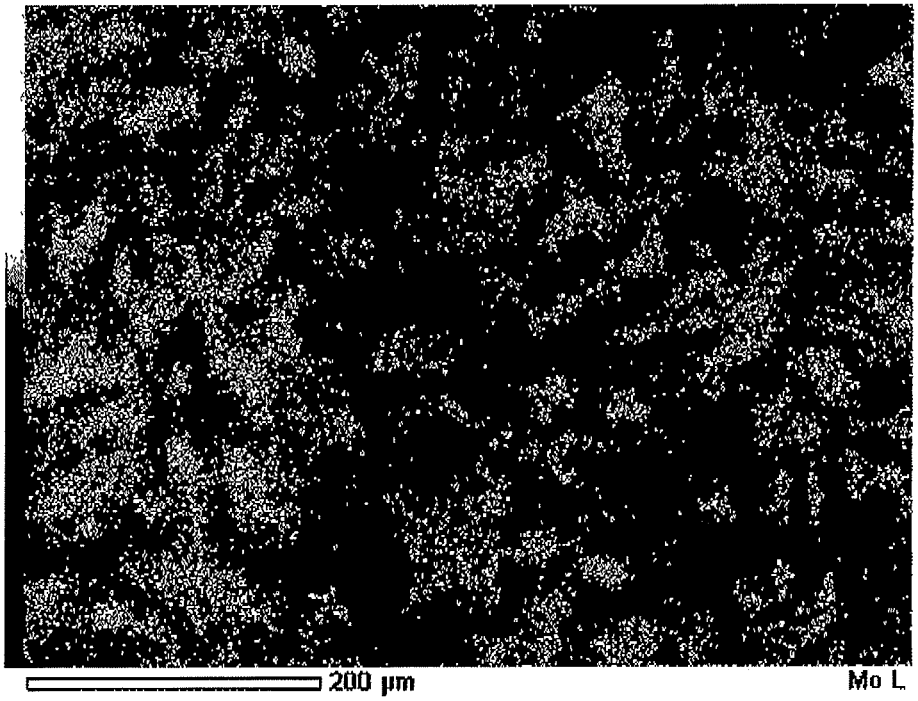

Fig. 13
(a)
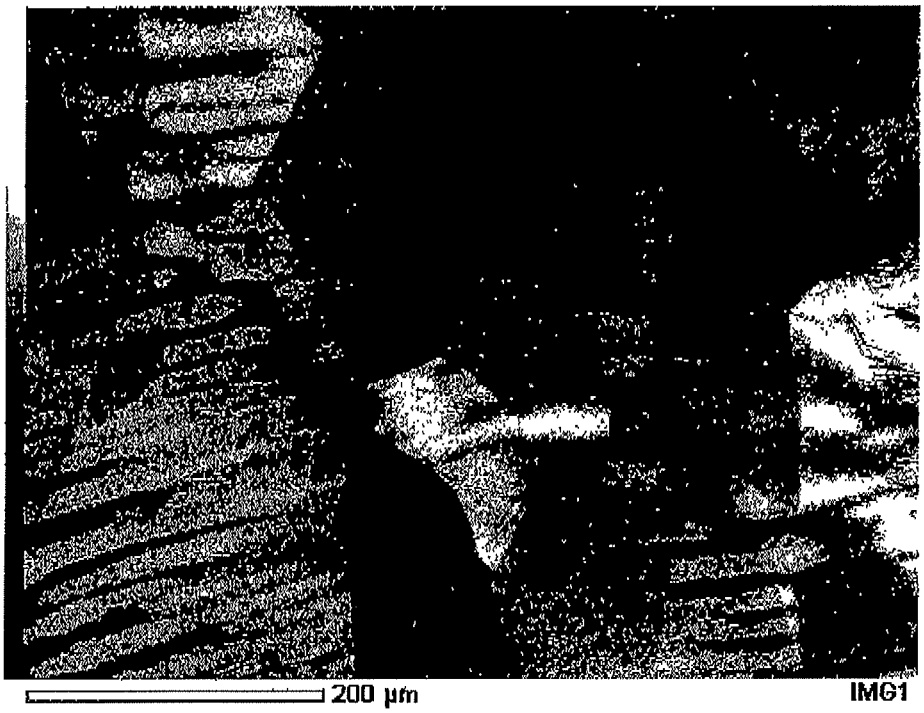
(b)
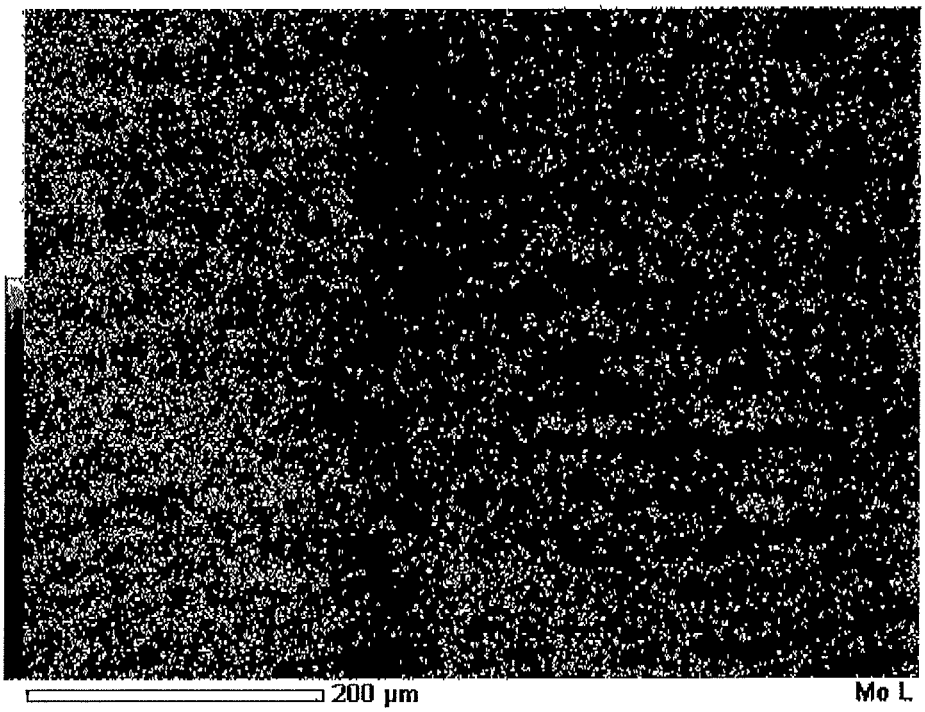

TI—MO ALLOY AND METHOD FOR PRODUCING THE SAME

TECHNICAL FIELD

The present invention relates to a Ti—Mo alloy and a method for producing the same. More particularly, the invention is concerned with a Ti—Mo alloy collectively having an Mo content of 10 to 20 mass %, wherein the Ti—Mo alloy has a winding belt-like or swirly segregation portion having a width of 10 to 20 μm in the plane of a backscattered electron image (BEI) or an energy dispersive X-ray spectroscopy (EDS) image of the Ti—Mo alloy, as examined under a scanning electron microscope, in which Mo content is larger than the collective Mo content of the Ti—Mo alloy.

Further, there are provided the Ti—Mo alloy which has been subjected to solution treatment in such a temperature range that a beta phase is solely present in the processed material and to aging treatment in such a temperature range that an omega phase is precipitated so that an aged omega phase is precipitated along the segregation portion, and a method for producing the same.

BACKGROUND ART

A Ti—Mo alloy having a beta phase with a body-centered cubic crystal structure as a main phase has advantageous features such that the corrosion resistance is excellent, shape memory properties are exhibited, and the Young's modulus is low, and an alloy having a Ti-15 mass % Mo composition has been mainly used. As examples of uses of the Ti—Mo alloy, there can be mentioned the use as a medical wire having shape memory properties as shown in PTL 1 and the use as a medical implant material as shown in PTL 2.

The Ti—Mo alloy is maintained at a high temperature such that the alloy is in the state in which a beta phase is solely present in the alloy (single beta-phase state), and then cooled to room temperature at such a high rate that no second phase (alpha phase) is precipitated so that the alloy is maintained in the single beta-phase state to room temperature, and the resultant alloy in this state exhibits especially high corrosion resistance.

However, the Ti—Mo alloy in the single beta-phase state does not exhibit a high value of yield stress at room temperature, for example, a Ti-15 mass % Mo alloy exhibits a yield stress at room temperature as low as about 400 MPa.

When the Ti—Mo alloy is subjected to heat treatment to precipitate an alpha phase with a hexagonal close-packed crystal structure, the yield stress is drastically increased to about 700 MPa as shown in NPL 1. However, the corrosion resistance of the resultant alloy is degraded, causing a problem in the resistance to crevice corrosion.

As a method for improving the Ti—Mo alloy in yield stress at room temperature while maintaining high corrosion resistance, a method has been known in which the Ti—Mo alloy material in the single beta-phase state is maintained at a temperature at which an omega phase of a trigonal crystal structure is precipitated, thus precipitating an omega phase (aged omega phase).

The omega phase (aged omega phase) precipitated by this method is so hard that the Ti—Mo alloy is remarkably improved in the yield stress at room temperature. However, the aged omega phase is a very brittle phase. Therefore there is a problem in that the precipitation of the aged omega phase in the alloy drastically reduces the ductility at room temperature.

There has not been a method for improving both the yield stress and ductility at room temperature with respect to the alloy in which an omega phase is precipitated. For this reason, in the conventional process for producing a Ti—Mo alloy, as shown in PTLs 1 and 2, the treatment temperature conditions and the composition of the alloy have been determined so that no aged omega phase is precipitated.

On the other hand, NPLs 2 and 3 have reported an example in which a structure in a swirly form is caused in a certain type of titanium-based alloy, i.e., a titanium-based intermetallic alloy to improve the ductility at room temperature.

For example, NPL 2 has reported that when a Ti—Al—Nb—Zr—Mo intermetallic-based alloy is subjected to hot extrusion, segregation in a swirly form is caused in the material, and the segregation causes a change in the order parameter of the arrangement of alloy elements, so that a hard portion and a soft portion are formed in the material, improving the ductility at room temperature.

The method for improving the ductility at room temperature described in NPL 2 utilizes a change in the order parameter of the arrangement of elements and can be applied to an intermetallic based alloy having ordered arrangement of alloy elements, but cannot be applied to an alloy having disordered arrangement of the alloy elements, such as a Ti—Mo alloy.

Further, NPL 3 has reported that when a Ti—Al—Nb—Zr—Mo intermetallic based alloy is subjected to hot caliber rolling and heat treatment in the temperature range where the second phase coexists, segregation of Nb and Mo elements in a swirly form is caused in the material, and further a specific microstructure in a swirly form such that second phase particles are precipitated in the areas in which Nb and Mo are dilute is obtained, and that the presence of the second phase particles increases the resistance to crack propagation during the deformation before breakage, improving the total elongation at room temperature.

However, the method of NPL 3 for improving the total elongation at room temperature has a problem in that the precipitation of second phase particles markedly reduces the corrosion resistance, and the like, and therefore cannot be applied to a Ti—Mo alloy.

CITATION LIST

Patent Literature

[PTL 1] JP-A-59-56554

[PTL 2] JP-T-2008-531843 (the term "JP-T" as used herein means a published Japanese translation of a PCT patent application)

Non Patent Literature

[NPL 1] X. H. Min et al. Materials Science and Engineering A 527 (2009) 1480-1488

[NPL 2] S. Naka et al. Materials Science and Engineering A 192/193 (1995) 69-76

[NPL 3] S. Emura et al. Materials Science and Engineering A 528 (2010) 355-362

[NPL 4] R. Davis at al. Journal of Materials Science 14 (1979) 712-722

[NPL 5] S. Otani et al., Journal of the Japan Institute of Metals 35 (1971) 92-97

[NPL 6] B. S. Hickman, Trans AIME, 245 (1969), 1329-1336

[NPL 7] E. W. Collings Materials Properties Handbook: Titanium Alloys, ASM, (1994), p. 10.

[NPL 8] H. Matsumoto et al., Journal of the Japan Institute of Metals 67 (2003) 635-642

SUMMARY OF INVENTION

Technical Problem

A task of the present invention is to provide a Ti—Mo alloy material which can be improved in the yield stress at room temperature while maintaining large ductility at room temperature and a method for producing the same.

Solution to Problem

For achieving the above task, the invention of the present application has the following features.

(1) Provided is a Ti—Mo alloy collectively having an Mo content of 10 to 20 mass %, wherein the Ti—Mo alloy has a winding belt-like or swirly segregation portion having a width of 10 to 20 μm in the plane of a backscattered electron image (BEI) or an energy dispersive X-ray spectroscopy (EDS) image of the Ti—Mo alloy, as examined under a scanning electron microscope, in which Mo content is larger than the collective Mo content of the Ti—Mo alloy.

(2) Provided is the above-mentioned Ti—Mo alloy, which has been subjected to aging treatment so that an aged omega phase is precipitated along the segregation portion in the plane of a backscattered electron image (BEI) or an energy dispersive X-ray spectroscopy (EDS) image of the Ti—Mo alloy, as examined under a scanning electron microscope.

(3) Provided is the above-mentioned Ti—Mo alloy, wherein the collective Mo content of the Ti—Mo alloy is 10 to 20 mass % and the remainder comprises an impurity inevitably contained and Ti.

(4) Provided is the above-mentioned Ti—Mo alloy, which collectively contains Mo in an amount of 10 mass % or more and further contains at least one element of Ta, Nb, W, V, Cr, Ni, Mn, Co, and Fe so that an Mo equivalent represented by the formula below becomes 20 or less, and which has the remainder comprising an impurity inevitably contained and Ti.

Mo equivalent=Mo content (mass %, which applies to the following)+Ta content/5+Nb content/3.5+W content/2.5+V content/1.5+Cr content×1.25+Ni content×1.25+Mn content×1.7+Co content×1.7+Fe content×2.5

(5) Provided is a method for producing the Ti—Mo alloy, wherein the method comprises subjecting an ingot, which is produced by an ordinary ingot making process for a titanium alloy, and which collectively has an Mo content of 10 to 20 mass %, to mechanical processing in the state in which the ingot is circumferentially restrained so that the cross-sectional area of the material obtained after the processing becomes 10% or less of the initial ingot cross-sectional area.

(6) Provided is the method for producing the Ti—Mo alloy, wherein the mechanical processing in the state in which the ingot is circumferentially restrained is performed at a temperature in the range of from room temperature to 1,100° C.

(7) Provided is the method for producing the Ti—Mo alloy, wherein, after the mechanical processing in the state in which the ingot is circumferentially restrained, the resultant material is subjected to solution heat treatment at a temperature in the range of from the beta transformation temperature to 1,100° C. so that a beta phase is solely present in the material.

(8) Provided is the method for producing the Ti—Mo alloy, wherein the material obtained after the solution heat treatment is subjected to cooling at a rate of 20° C./min or more so that no alpha phase is precipitated.

(9) Provided is the method for producing the Ti—Mo alloy, wherein the material obtained after the solution heat treatment and cooling is subjected to aging treatment in which the temperature is maintained in the range of from 150 to 500° C. for one minute to 100 hours to precipitate an omega phase.

(10) Provided is the method for producing the Ti—Mo alloy, wherein the material obtained after the solution heat treatment and cooling is subjected to aging treatment at a temperature in the range of from 200 to 250° C. for a period of time in the range of from 1 to 10 hours to precipitate an omega phase along an Mo segregation structure in a winding belt-like form or swirly form, producing a Ti—Mo alloy having both excellent total elongation at room temperature and high tensile strength at room temperature.

Advantageous Effects of Invention

The Ti—Mo alloy of the invention according to item (1) above has high corrosion resistance and excellent formability, and further, by processing the Ti—Mo alloy into a desired form and then subjecting the formed alloy to aging treatment, an aged omega phase which has high strength but is brittle is caused in the formed alloy, so that the form of the alloy is set, thus obtaining a high-strength, high-ductility Ti—Mo alloy having both high strength and satisfactory ductility at room temperature.

The Ti—Mo alloy of the invention having precipitated therein an aged omega phase according to item (2) above solves the problem of the lowering of ductility at room temperature, which problem is caused when an aged omega phase is uniformly precipitated by the conventional method to improve the Ti—Mo alloy in yield strength at room temperature, by a method in which an aged omega phase is precipitated along the Mo segregation by special mechanical processing and heat treatment to form a region containing a high amount of the omega phase, thus having high yield strength and poor ductility, and a region containing a small amount of the omega phase, thus having low strength and high ductility, and by combining these regions so that the regions are intertwined in a swirly form. A Ti—Mo alloy having high strength and satisfactory ductility at room temperature can be provided.

Further, in the invention, an alpha phase which causes the corrosion resistance to be poor is not used for improving the yield strength, and therefore an alloy having high corrosion resistance can be provided.

BRIEF DESCRIPTION OF DRAWINGS

[FIG. 1] They are a backscattered electron image (BEI) (a) and an energy dispersive X-ray spectroscopy (EDS) image (b) showing the Mo concentration distribution in the Ti-12 mass % Mo alloy ingot produced in Example 1.

In the BEI, the black area in the upper half and the gray area in the lower half have grains different from each other, and the boundary between them corresponds to the grain boundary. The difference between the black and the gray is caused by a difference between the orientations of the grains.

Figure 2:
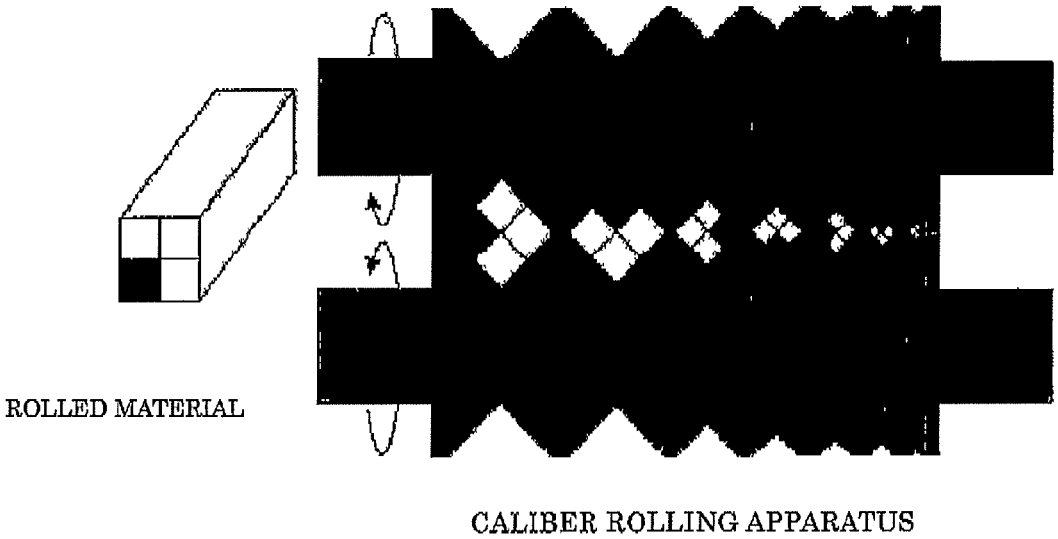

[FIG. 2] It is a schematic diagram of the caliber rolling used in the Examples and Comparative Examples as means for mechanical processing in the state in which the ingot is circumferentially restrained.

[FIG. 3] They are a backscattered electron image (BEI) (a) and an energy dispersive X-ray spectroscopy (EDS) image (b) showing the Mo concentration distribution in the plane perpendicular to the rolling direction with respect to the material obtained in Example 1 by subjecting the Ti-12 mass % Mo alloy ingot to hot forging, hot caliber rolling, and solution treatment.

In the BEI, the black, gray, and white areas have grains different from one another. The state in which the size of the grains is reduced by the rolling and heat treatment, as compared to that in the ingot, is observed.

[FIG. 4] They are a backscattered electron image (BEI) (a) and an energy dispersive X-ray spectroscopy (EDS) image (b) showing the Mo concentration distribution in the plane parallel with the rolling direction with respect to the material obtained in Example 1 by subjecting the Ti-12 mass % Mo alloy ingot to hot forging, hot caliber rolling, and solution treatment.

[FIG. 5] They are flowcharts showing the process for producing a Ti-12 mass % Mo alloy in Example 1 and Comparative Example 1.

[FIG. 6] They are a backscattered electron image (BEI) (a) and an energy dispersive X-ray spectroscopy (EDS) image (b) showing the Mo concentration distribution in the plane perpendicular to the rolling direction with respect to the material obtained in Comparative Example 1 by subjecting the Ti-12 mass % Mo alloy to solution treatment, which material has no segregation portion in a winding belt-like form or swirly form having a width of 10 to 20 μm.

In the mapping for forming an EDS image, the presence of Mo (or another element) is indicated as a point having a certain size, and the number of points in a region is increased according to the increase of the amount of Mo contained in the region, and, as a result, the distribution of the Mo element is represented by the shade of color. Therefore, even when the Mo distribution is completely uniform, it is likely that fine points of shade are shown in the EDS mapping. In FIG. 6(*b*), there is no local shade of color, which indicates that almost no segregation is present.

Figure 7:
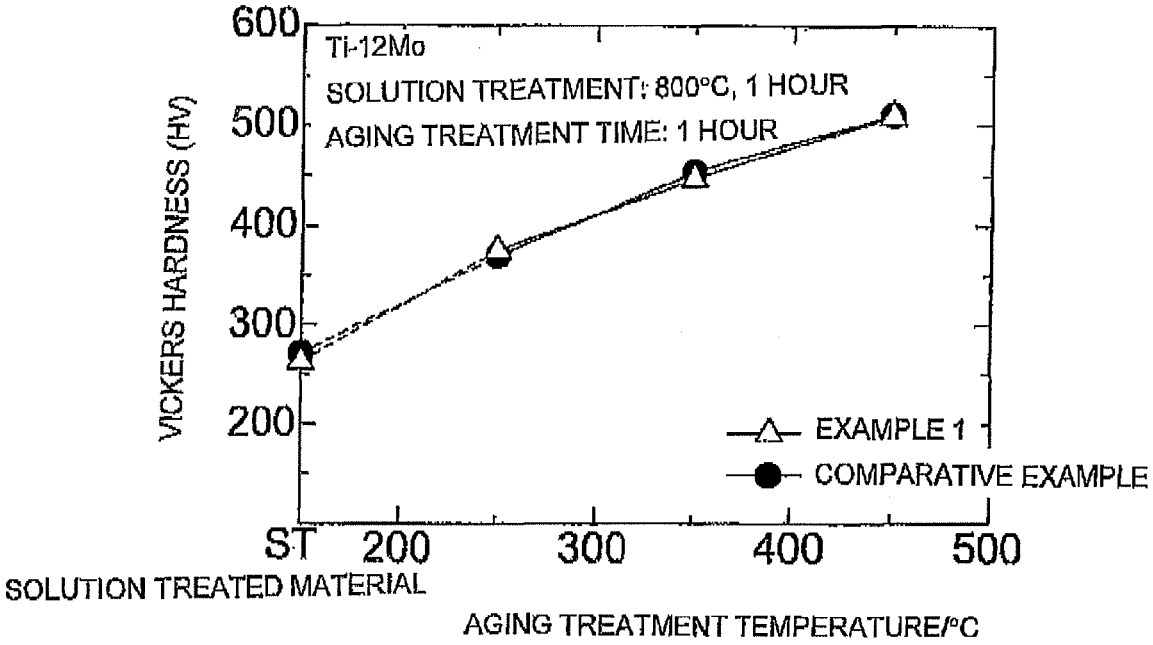

[FIG. 7] It is a graph obtained by plotting the values of Vickers macrohardness of the plane perpendicular to the rolling direction with respect to the materials obtained by subjecting the material obtained after the solution heat treatment in Example 1 and Comparative Example 1 to aging treatment at 250° C., 350° C., and 450° C. for one hour.

In the "SOLUTION TREATED MATERIAL (ST material)" which is the material obtained after the solution treatment and water cooling, a quenched omega phase is precipitated, and the quenched omega phase precipitated has a size as small as several nm and hence has almost no effect on the macrohardness of the material, and the material exhibits a low Vickers macrohardness. On the other hand, the reason why the material obtained after the aging treatment has a high Vickers hardness resides in that a hard aged omega phase is precipitated in the material.

Figure 8:
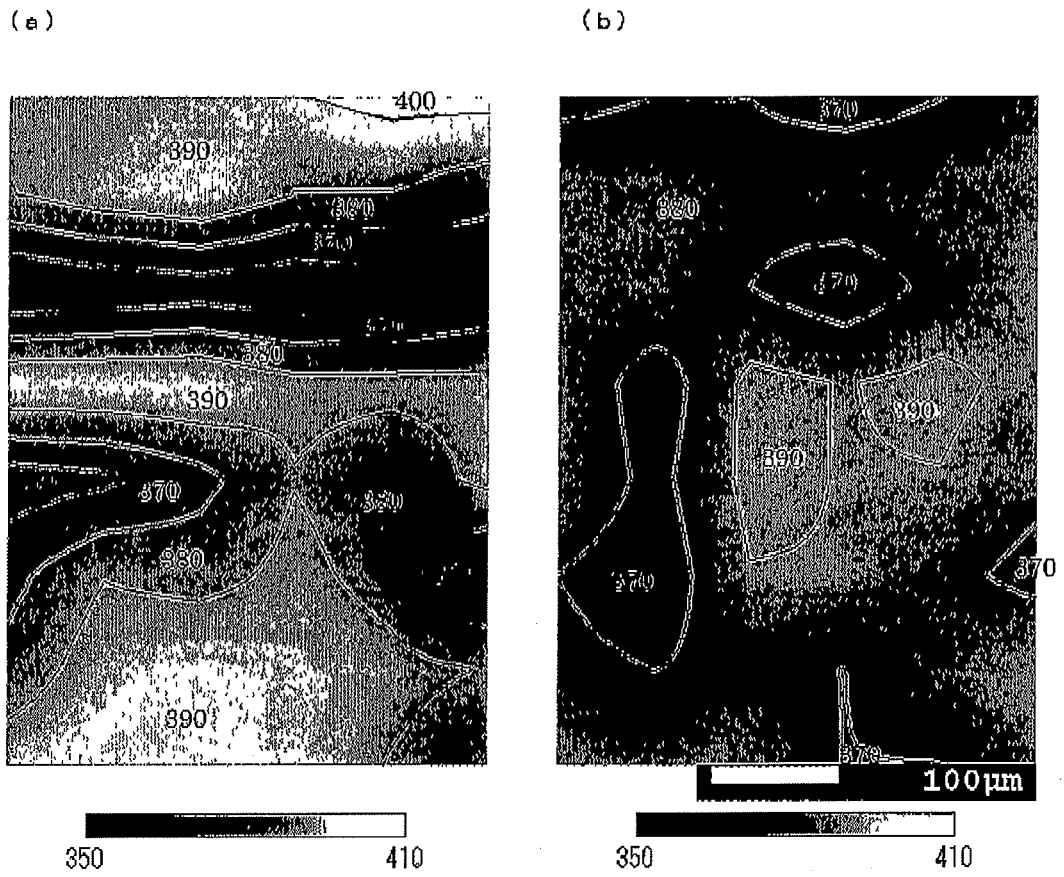

[FIG. 8] They are views showing the distribution of Vickers microhardness on the plane parallel with the rolling direction with respect to the materials in Example 1(a) and Comparative Example 1(b), which have been subjected to aging treatment at 250° C. for one hour.

The solid line in the figures indicates a line joining points of equal hardness. In Example 1 (a), the values of Vickers microhardness in a wide range of from about 360 to about 400 are present. In Comparative Example 1 (b), only the values of hardness in a range of from about 370 to about 390 are present, which indicates that the distribution of the hardness is narrow, as compared to that in Example 1.

Figure 9:
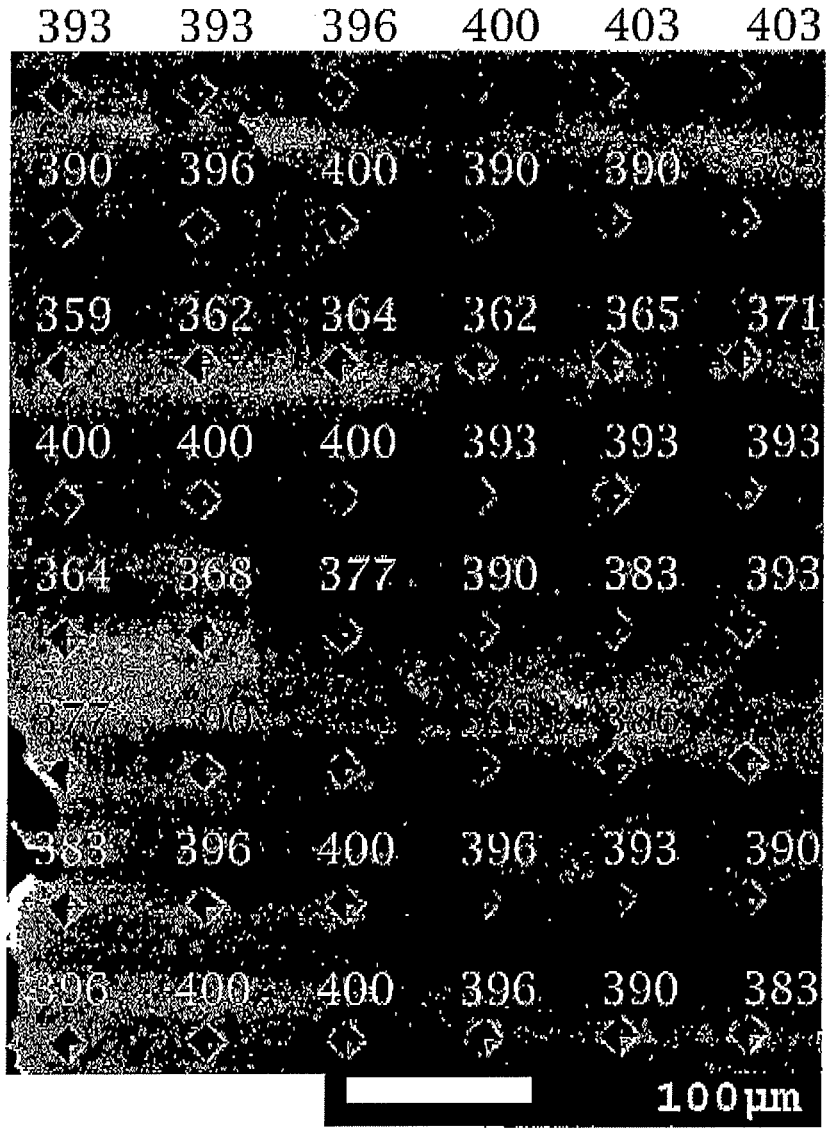

[FIG. 9] It is a view showing the microhardness distribution on the plane parallel with the rolling direction with respect to the material in Example 1, which has been subjected to aging treatment at 250° C. for one hour.

The Mo concentration is indicated by the gradation of the contrast in a belt-like form in the background of the BEI. The gradation of the contrast in the BEI is consistent with the gradation for Mo in the EDS image, and an area exhibiting a bright contrast which is nearly white indicates a large Mo amount, and an area exhibiting a dark contrast which is nearly black indicates a small Mo amount. (There are other contrast factors, such as a difference in the orientation of grains, but, in the invention, attention is focused mainly on the contrast caused by the large or small Mo amount.)

The area having a bright contrast which is nearly white has a low Vickers hardness. For example, the points in the line 3 from top are disposed on the white contrast, and have a Vickers hardness as low as 359 to 371.

On the other hand, the area having a dark contrast which is nearly black has a high Vickers hardness. For example, the points in the line 1 from top are disposed on the black contrast, and have a Vickers hardness as high as 393 to 403.

Figure 10:
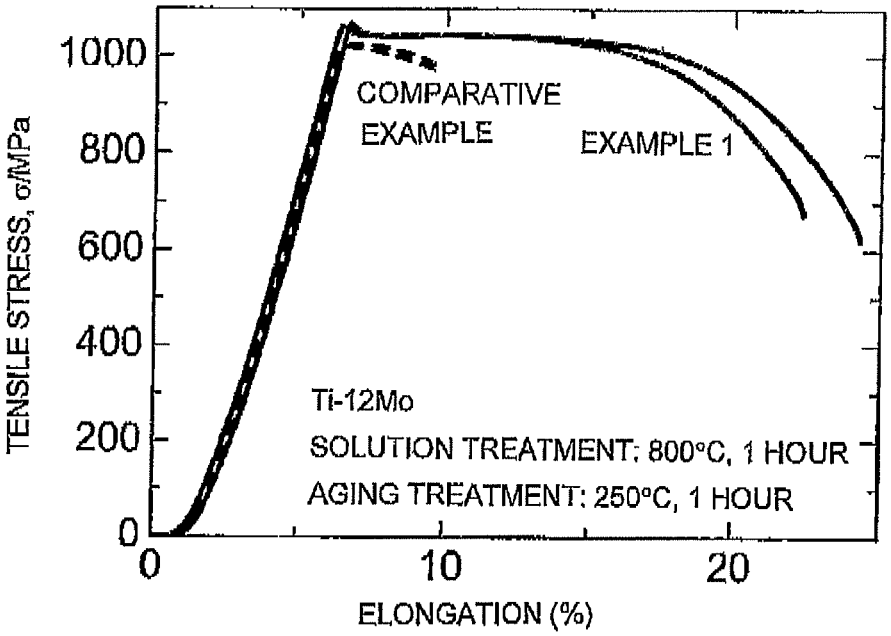

[FIG. 10] It is a graph showing the results of the tensile test at room temperature with respect to the materials in Example 1 and Comparative Example 1, which have been subjected to aging treatment at 250° C. for one hour.

In each of Example 1 and Comparative Example 1, two specimens for tensile test are prepared and a tensile test at room temperature is conducted two times, and therefore two tensile curves are shown. In Comparative Example 1, there is no difference in the change before breakage between the two specimens, and hence the resultant tensile curves substantially overlap.

[FIG. 11] They are a backscattered electron image (BEI) (a) and an energy dispersive X-ray spectroscopy (EDS) image (b) showing the Mo concentration distribution in the plane perpendicular to the rolling direction with respect to the material obtained in Example 2 by subjecting the Ti-18 mass % Mo alloy to hot forging, hot caliber rolling, and solution heat treatment.

Figure 12:
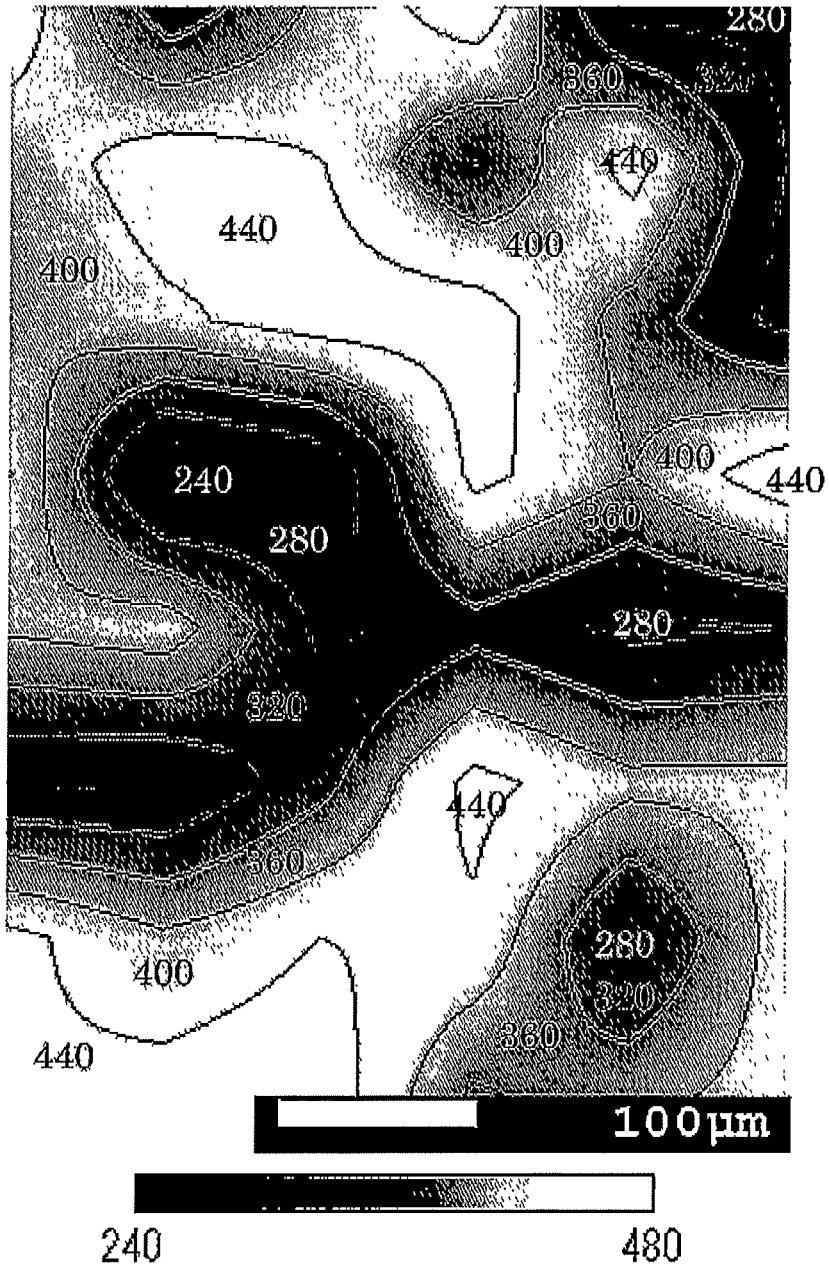

[FIG. 12] It is a view showing the distribution of Vickers microhardness on the plane perpendicular to the rolling direction with respect to the material in Example 2, which has been subjected to aging treatment at 450° C. for one hour.

[FIG. 13] They are a backscattered electron image (BEI) (a) and an energy dispersive X-ray spectroscopy (EDS) image (b) showing the Mo concentration distribution in the plane perpendicular to the rolling direction with respect to the material obtained in Comparative Example 2 by subjecting the Ti-9 mass % Mo alloy to hot forging, hot caliber rolling, and solution heat treatment.

DESCRIPTION OF EMBODIMENTS

The invention has the above-mentioned characteristic feature, and, hereinbelow, an embodiment of the invention will be described.

<Alloy Composition of the Ti—Mo Alloy>

The collective average Mo content of the Ti—Mo alloy having an aged omega phase precipitated in a winding belt-like form or swirly form is preferably in the range of from 10 to 20 mass %, further preferably from 12 to 18 mass %.

When the collective average Mo content of the Ti—Mo alloy is less than 10 mass %, as seen in the BEI and EDS image (see FIG. 13) showing the Mo concentration distribution in the plane perpendicular to the rolling direction with respect to Comparative Example 2 in which the collective average Mo content of the Ti—Mo alloy is 9 mass % (the material obtained by subjecting the Ti-9 mass % Mo alloy ingot to hot forging at 1,000° C., hot caliber rolling at 650° C., and solution heat treatment at 800° C. for one hour), a segregation portion having a large Mo amount is present in a straight belt-like form having a length of 200 μm or more without winding after the hot caliber rolling.

When the collective average Mo content of the Ti—Mo alloy is less than 10 mass %, the structure in the invention in which an Mo segregation portion in a winding belt-like form or swirly form having a width of 10 to 20 μm is present is not formed. Even when generally observing the entire plane examined, a segregation structure in a winding belt-like form or swirly form cannot be observed.

It is considered that when the collective average Mo content of the Ti—Mo alloy is less than 10 mass %, a martensite phase is caused due to the cooling after the solution heat treatment, so that the structure in the invention cannot be formed (see NPL 4).

Further, for more effectively achieving the precipitation of an aged omega phase along a plurality of segregation portions in a winding belt-like form or swirly form having a width of 10 to 20 μm, the collective average Mo content of the Ti—Mo alloy is preferably 12 mass % or more.

On the other hand, according to NPL 5, when the Mo content of the Ti—Mo alloy is more than 20 mass %, the Ti—Mo alloy is lowered in processability. Further, in NPL 5, the results of the measurement of thermal expansion and hardness show that the amount of the aged omega phase precipitated in the Ti-20 mass % Mo alloy is markedly reduced, as compared to that in an alloy containing Mo in an amount of 12 mass % or 15 mass %. Furthermore, NPL 6 has a description showing that even when a Ti-14 at % Mo(approximately Ti-24 mass % Mo) alloy is subjected to aging treatment, no precipitation of an omega phase is found. In an alloy such that the collective average Mo content of the Ti—Mo alloy is more than 20 mass %, the amount of the aged omega phase precipitated is extremely small, so that it is difficult to locally cause a hard site due to the precipitation of an aged omega phase to change the material in mechanical properties. Therefore, the Mo content is required to be 20 mass % or less, and further, for precipitating the aged omega phase as a reinforcing phase in a satisfactory amount, the Mo content is preferably 18 mass % or less.

By the way, the Ti—Mo alloy can contain, in addition to Mo in an amount of 10 mass % or more, an element for stabilizing the beta phase, such as Ta, Nb, W, V, Cr, Ni, Mn, Co, or Fe. In this case, the total of the incorporated elements for stabilizing the beta phase of the Ti-based alloy is collectively determined as an "Mo equivalent" on the basis of Mo element, and indicated as a yardstick for stabilization of the beta phase, and a method for determining the Mo equivalent is represented by the formula below (see NPL 7: E. W. Collings: Materials Properties Handbook Titanium Alloys, ASM (1994), p. 10).

The Mo equivalent value calculated by the formula below is preferably 20 or less, further preferably 12 to 18.

Mo equivalent=Mo content (mass %, which applies to the following)+Ta content/5+Nb content/3.5+W content/2.5+V content/1.5+Cr content×1.25+Ni content×1.25+Mn content×1.7+Co content×1.7+Fe content×2.5

The Mo equivalent is an index of the ability to stabilize the beta phase with respect to an element added to the titanium alloy, and, when the above-mentioned various elements for stabilizing the beta phase are added to the Ti—Mo alloy, the stability of the beta phase in the resultant Ti-based alloy having a value of "Mo equivalent" calculated by the formula above is substantially equal to that of a Ti—Mo binary alloy containing solely Mo and having the same "Mo equivalent".

When the alloy contains, in addition to Mo, an element for stabilizing the beta phase, for obtaining the state of Mo segregation with an aged omega phase in a swirly form having a width of 10 to 20 μm in the invention, the collective average Mo content of the Ti—Mo alloy is required to be 10 mass % or more. Further, for more effectively achieving the state of segregation with an aged omega phase in a swirly form, the Mo equivalent is preferably 12 or more.

When the Mo equivalent is more than 20, the stability of the beta phase in the Ti—Mo alloy is similar to that in the Ti—Mo binary alloy having an Mo content of more than 20 mass %, and the amount of the aged omega phase precipitated is reduced, so that it is difficult to locally change the hardness due to the precipitation of an aged omega phase. Therefore, the Mo equivalent is required to be 20 or less, and further, for precipitating the aged omega phase as a reinforcing phase in a satisfactory amount, the Mo equivalent is preferably 18 or less.

<Ingot Making Process for Titanium Alloy>

Ingot making of the Ti—Mo alloy having the above-mentioned composition is performed by an ordinary ingot making process for a titanium alloy. In Examples 1 and 2, ingot making of the alloy material is performed using a cold crucible levitation melting apparatus, but another ordinary method used for ingot making of a titanium alloy (consumable electrode-type vacuum arc melting, electron beam melting, or plasma arc melting) can be used.

<Mechanical Processing in the State in which the Ingot is Circumferentially Restrained>

The ingot produced by the above-mentioned process is processed into a rod or a wire through processes of forging, rolling, and the like. In the Examples and Comparative Examples, the ingot material is processed into a rod by hot forging and hot caliber rolling, but the hot forging is conducted for processing the ingot material into a size such that the material can be rolled by a hot caliber rolling apparatus, and the hot forging can be omitted.

On the other hand, for controlling the state of Mo segregation of a structure in a winding belt-like form or swirly form, processing, such as caliber rolling, extrusion, or wire drawing, must be conducted in the state in which the material to be processed is circumferentially restrained. As an example of the mechanical processing in the state in which the ingot is circumferentially restrained, a schematic diagram of the caliber rolling used in the Examples and Comparative Examples is shown in FIG. 2.

In the processing in the state in which the ingot is circumferentially restrained, the ingot is required to be processed so that the cross-sectional area of the rod or wire obtained after the processing preferably becomes 10% or less, further preferably 5% or less of the initial ingot cross-sectional area.

In Example 1, in the production of an ingot using a cold crucible levitation melting apparatus, segregation having a width of about 30 to 50 μm is caused in the Ti-12 mass % Mo alloy ingot (see FIG. 1).

In the production of an ingot by the other ingot making method, the cooling rate for the ingot is small, as compared to that in the production of an ingot using a cold crucible levitation melting apparatus, and hence the width of the Mo segregation in the ingot is expected to be larger than 30 to 50 μm. Therefore, for achieving the Mo segregation having a width of 10 to 20 μm after the processing, it is preferred that the cross-sectional area after the processing is 5% or less of that before the processing.

The temperature at which the mechanical processing in the state in which the ingot is circumferentially restrained is performed is preferably a temperature in the range of from room temperature to 1,100° C., further preferably a temperature in the range of from 600° C. to a temperature 200° C. higher than the beta transformation temperature.

When the temperature for the processing is higher than 1,1000° C., the diffusion of Mo becomes active during the hot processing so that a region having a large Mo amount and a region having a small Mo amount are likely to cause a larger pattern than the structure in a swirly form having a width of 10 to 20 μm, making it difficult to obtain an alloy having both excellent processability and excellent strength. Therefore, the mechanical processing is required to be performed at a temperature in the range of from room temperature to 1,100° C.

On the other hand, in the Ti—Mo alloy, two phases, i.e., an alpha phase and a beta phase coexist at a temperature lower than a temperature of about 800° C. as a boundary, and a beta phase is solely present at a temperature higher than that temperature. It is noted that this depends also on the Mo content in a strict sense. This temperature is called a beta transformation temperature, and, when the processing or heat treatment is performed at a temperature extremely higher than the beta transformation temperature, the beta phase becomes extremely coarse, so that mechanical properties of the material, particularly, yield strength and ductility at room temperature are adversely affected. For preventing the beta phase from becoming extremely coarse, the processing is preferably performed in a temperature range which does not exceed the beta transformation temperature by 200° C. or more.

Generally, when a metal material is subjected to mechanical processing at room temperature or a low temperature around room temperature, a work-hardening phenomenon such that the material is hardened during the processing is likely to occur, making it difficult to achieve satisfactory processing in the subsequent process. Further, a hard aged omega phase is likely to be precipitated during the processing at a temperature in the range of from 150 to 600° C., making the subsequent processing difficult. Therefore, a series of processing is preferably performed at a temperature of 600° C. or higher.

<Solution Heat Treatment>

The temperature range for the solution heat treatment after the mechanical processing is preferably a temperature in the range of from the beta transformation temperature to 1,100° C., further preferably a temperature in the range of from the beta transformation temperature to a temperature 200° C. higher than the beta transformation temperature.

The solution heat treatment is performed for causing a satisfactory amount of an aged omega phase to be precipitated in the beta phase matrix in the subsequent aging treatment, and, for achieving this, the material before subjected to aging treatment must have solely a beta phase. Therefore, the solution heat treatment is required to be performed at the beta transformation temperature or higher. On the other hand, when the temperature for the solution heat treatment is higher than 1,100° C., active diffusion of Mo is caused, so that an Mo segregation structure in a swirly form having a width of 10 to 20 μm cannot be obtained. Therefore, the solution heat treatment is required to be performed at a temperature of 1,100° C. or lower.

Further, when the solution heat treatment is performed at a temperature extremely higher than the beta transformation temperature, the beta phase becomes extremely coarse, so that mechanical properties, such as yield strength and ductility at room temperature, are adversely affected. Therefore, the solution heat treatment is preferably performed at a temperature in the range of from the beta transformation temperature to a temperature 200° C. higher than the beta transformation temperature.

<Cooling after the Solution Heat Treatment>

In the cooling step after the solution heat treatment, it is necessary to use a cooling rate of 20° C./min or more so that no alpha phase is precipitated. This cooling is generally made by water cooling, but cooling using cooling gas or cooling liquid, such as a quenching oil, or air cooling may be employed as long as a cooling rate of 20° C./min or more is used.

When the Ti—Mo alloy of the invention is cooled from the temperature for the solution heat treatment at a high rate using a large amount of cold water, an omega phase different from the aged omega phase (quenched omega phase) is caused. The quenched omega phase has a size of several nm which is very small, as compared to the size of the aged omega phase as shown in NPL 8, and has almost no effect on the mechanical properties including hardness and yield stress. This is also apparent from the results shown in FIG. 7 that the material cooled with water after the solution heat treatment has a small Vickers hardness, as compared to the material having precipitated therein an aged omega phase.

Therefore, in the selection of the cooling rate after the solution heat treatment, it is not necessary to take the precipitation of quenched omega phase into consideration.

<Aging Treatment for Precipitating an Aged Omega Phase>

The temperature of the aging treatment for precipitating an aged omega phase is preferably a temperature in the range of from 150 to 500° C., further preferably a temperature in the range of from 250 to 450° C.

When the aging treatment is performed at a temperature of lower than 150° C., no aged omega phase is precipitated even when the aging treatment is continued for a practically acceptable long period of time. On the other hand, when the aging treatment is performed at a temperature of higher than 500° C., the amount of the aged omega phase precipitated is reduced and an alpha phase is precipitated. The Mo content of the alpha phase is smaller than the average Mo content of the alloy, and hence the precipitation of the alpha phase increases the Mo content of the beta phase matrix. The increase of the Mo content of the beta phase stabilizes the beta phase, so that the precipitation of an aged omega phase is further suppressed. Therefore, the aging treatment is required to be performed at a temperature in the range of from 150 to 500° C.

Further, for precipitating an aged omega phase in a satisfactory amount in the beta phase matrix, the aging treatment is preferably performed at a temperature in the range of from 250 to 450° C. at which the precipitation of an aged omega phase actively occurs.

The time of the aging treatment for precipitating an aged omega phase is preferably one minute to 100 hours, further preferably 10 minutes to 10 hours.

With the aging treatment for a period of time of less than one minute, an omega phase does not precipitate in a satisfactory amount, and therefore the time of the aging treatment is required to be one minute or longer. Further, for preventing dispersion of the amount of the precipitated omega phase caused due to the time of the aging treatment, the time of the aging treatment is preferably 10 minutes or longer.

On the other hand, taking into consideration of the practical process for efficiently producing the Ti—Mo alloy, the time of the aging treatment is preferably 100 hours or less, further preferably 10 hours or less.

The thus precipitated phase is an omega phase and is neither an alpha phase nor a beta phase, which has been confirmed by a non-destructive X-ray diffraction analysis method.

EXAMPLES

Example 1

A Ti-12 mass % Mo ingot (diameter: 69 mm; weight: 1.2 kg) was produced using a cold crucible levitation melting (CCLM) apparatus. The Mo concentration distribution in the produced ingot was examined using a backscattered electron image (BEI) and an energy dispersive X-ray spectroscopy (EDS) image obtained by means of a scanning electron microscope (SEM). As a result, as shown in FIG. 1, a segregation structure in which the region having a high Mo concentration is present in a dendritic form having a width of 30 to 50 μm was obtained.

The above-produced ingot was subjected to hot forging at 1,000° C. and hot caliber rolling at 650° C. to form an 11.8 mm square rod, and then the resultant rod was subjected to solution heat treatment at 800° C. for one hour, followed by water cooling. The Mo concentration distribution in the material obtained after the solution treatment was examined using a BEI and EDS. As a result, as shown in FIG. 3, a structure in which the Mo segregation is in a swirly form having a width of 10 to 20 μm in the plane perpendicular to the rolling direction was caused. Further, a similar BEI and EDS image were obtained with respect to the plane parallel with the rolling direction, and, as shown in FIG. 4, a structure in which the Mo segregation is long and extends continuously in a belt-like form in the rolling direction was caused.

With respect to 4 arbitrary points in FIG. 3 (2 points selected from the region having a large Mo amount and 2 points selected from the region having a small Mo amount), a quantitative analysis by EDS was conducted. As a result, it was found that among the points, the smallest Mo amount was 10.5 mass % and the largest Mo amount was 12.9 mass %, and a difference in the Mo amount between these points was 2.4 mass %.

Comparative Example 1

In Comparative Example 1, the Ti-12 Mo ingot produced under the same ingoting conditions as those in Example 1 was subjected to processing and heat treatment according to the below-mentioned process to produce a material which does not have the Mo segregation structure in Example 1. Specifically, the ingot was subjected to hot forging at 1,200° C. and hot caliber rolling to form a 17.5 mm square rod, and then the resultant rod was maintained at 1,200° C. for 3 hours, and then the oxide layer on the surface of the material was removed by abrasion, and the resultant rod was subjected to caliber rolling at room temperature to form an 11.8 mm square rod, and then the resultant rod was subjected to solution heat treatment at 800° C. for one hour, followed by water cooling. This process is intended to promote diffusion of Mo through Ti by processing at 1,200° C. and maintaining the temperature and to keep the grain size equivalent to that in Example 1 by the subsequent processing at room temperature and solution heat treatment at 800° C. FIG. 5 shows the respective production processes in Example 1 and Comparative Example 1.

The results of the measurement of the Mo concentration distribution by EDS in the plane perpendicular to the rolling direction are shown in FIG. 6. The degree of segregation was extremely small and unnoticeable, as compared to that of the material in Example 1 shown in FIG. 3. From the results of the quantitative analysis made with respect to 2 arbitrary points (1 point selected from the region having a large Mo amount and 1 point selected from the region having a small Mo amount), it was found that the Mo amounts of the respective points were 10.9 mass % and 11.6 mass % and a difference in the Mo concentration between the 2 points was as small as 0.7 mass %.

With respect to the materials obtained in Example 1 and Comparative Example 1 after the solution heat treatment and water cooling, and the materials which had been subjected to aging treatment at 250° C., 350° C., and 450° C. for one hour, a Vickers macrohardness of the plane perpendicular to the rolling direction was measured (load: 5 kg), and the results are shown in FIG. 7. The aging treatment increases the Vickers hardness (macrohardness) of a material, and, the higher the temperature of the aging treatment, the larger the increase of the Vickers hardness. The increase of the hardness is caused due to the precipitation or increase of an aged omega phase which is the hard second phase. Further, in both Example 1 and Comparative Example 1, substantially the same Vickers macrohardness is exhibited and no effect of the Mo segregation on the hardness is found.

On the other hand, using a Vickers microhardness tester, a microhardness of the plane parallel with the rolling direction under a load of 100 g was measured with respect to 48 points at intervals of 75 μm (6 points×8 points). As a result, it was found that, with respect to the material which had been subjected to aging at 250° C. for one hour, as shown in FIG. 8, a change in the microhardness of the material in Example 1 having the Mo segregation structure in a swirly form was locally increased.

Further, as shown in FIG. 9, the sites having a small microhardness were consistent with the sites having a large Mo amount. It is considered that the beta phase as a parent phase is stable in the region having a large Mo amount and hence a hard aged omega phase is unlikely to be precipitated in this region, reducing the microhardness.

With respect to the materials in Example 1 and Comparative Example 1, which had been subjected to aging at 250° C. for one hour, a tensile test was conducted at room temperature. As a result, it was found that, as shown in FIG. 10, these materials had a similar yield stress of about 1,100 MPa, but the material in Example 1 having the Mo segregation in a swirly form exhibited a larger total elongation.

Example 2

In Example 2, the results obtained with respect to the Ti-18 mass % Mo alloy are shown. Also in Example 2, by subjecting the material to the same processing and heat treatment as in Example 1 (hot forging at 1,000° C., grooved-roll hot rolling at 650° C., solution heat treatment at 900° C. for one hour, and water cooling), as shown in FIG. 11, an Mo segregation structure in a swirly form (change in Mo amount: 3.5 mass %) is obtained in the plane perpendicular to the rolling direction, and, as shown in FIG. 12, by virtue of the aging treatment at 450° C. for one hour, a structure in which the microhardness is locally changed can be obtained.

Comparative Example 2

In Comparative Example 2, the results obtained with respect to the Ti-9 mass % Mo alloy are shown. In Comparative Example 2, when subjecting the material to the same processing and heat treatment as in the Example (hot forging at 1,000° C., grooved-roll hot rolling at 650° C., solution heat treatment at 800° C. for one hour, and water cooling), as shown in FIG. 13, a region in which an Mo segregation portion in a dendritic form having a width of 200 μm or more is present and a region in which such a dendrite is not present are distributed, and thus a structure different from the structure in the Example is caused. Further, a difference in the Mo amount between the sites is as small as 1.2 mass %.

Example 3

The material obtained in Example 1 after the solution heat treatment and water cooling was subjected to aging treatment at a temperature of 200° C. for 10 hours, and, from the resultant material, two specimens for measurement (specimen A and specimen B) were prepared, and, in both the specimens, a segregation structure in a swirling form was clearly observed. With respect to each of the specimens, a deformation before breakage (total elongation) at room temperature was measured and the obtained values were 23% (specimen A) and 25% (specimen B), and a tensile strength at room temperature was measured and the obtained values were 1,010 σ/MPa (specimen A) and 1,020 σ/MPa (specimen B).

Example 4

The material obtained in Example 1 after the solution heat treatment and water cooling was subjected to aging treatment at a temperature of 250° C. for one hour, and, from the resultant material, two specimens for measurement (specimen C and specimen D) were prepared, and, in both the specimens, a segregation structure in a swirly form was clearly observed. With respect to each of the specimens, a deformation before breakage (total elongation) at room temperature was measured and the obtained values were 19% (specimen C) and 21% (specimen D), and a tensile strength at room temperature was measured and the obtained values were 1,012 σ/MPa (specimen C) and 1,015 σ/MPa (specimen D).

With respect to the Ti—Mo alloy material which has been subjected to aging treatment at a temperature of 200 to 250° C. for about 1 to 10 hours, it is expected that the alloy material having a good balance between excellent total elongation at room temperature and high tensile strength at room temperature can be obtained due to the Mo segregation structure in a swirly form.

Needless to say, the invention is not limited to the above-mentioned examples, and various embodiments can be employed with respect to the details.

INDUSTRIAL APPLICABILITY

The present invention achieves large total elongation while achieving high yield stress by virtue of the precipitation of an aged omega phase, and thus is more excellent than the conventional techniques. Specific examples of applications include structural members required to have a corrosion resistance and a strength as well as reliability, such as landing gears for aircraft and passenger airplane, marine structures, and chemical plants.

Further, as an application to a member required to have a corrosion resistance and mechanical properties at room temperature, the application to medical wire, implant and the like can be considered.

The invention claimed is:

1. A method for producing a Ti—Mo alloy comprising the steps of:

(A) subjecting an ingot prepared by cold crucible levitation melting, consumable electrode-type arc melting, electron beam melting or plasma arc melting, to mechanical processing in a state in which the ingot is circumferentially restrained at a temperature in a range of 600 to 1100° C. so that a cross-sectional area of a rod or wire obtained after the mechanical processing is 10% or less of an initial ingot cross-sectional area, wherein the ingot consists of Ti, Mo and inevitable impurities, and optionally at least one element for stabilizing a beta phase selected from the group consisting of Ta, Nb, W, V, Cr, Ni, Mn, Co and Fe, wherein the Mo content is 10 to 20 mass %, and a collective Mo equivalent content is 10 to 20 mass %, wherein the Mo equivalent=Mo content+Ta content/5+Nb content/3.5+W content/2.5+V content/1.5+Cr content×1.25+Ni content×1.25+Mn content×1.7+Co content×1.7+Fe content×2.5, all contents being in mass %;

(B) subjecting the material obtained after the mechanical processing of step (A) to a solution heat treatment at a temperature in a range of from a beta transition temperature to 1100° C. so that a beta phase is solely present in the material;

(C) cooling the material after the solution heat treatment of step (B) at a rate of 20° C./min or more so that no alpha phase is precipitated; and (D) subjecting the material after the cooling step of step (C) to an aging treatment at a temperature of 150 to 500° C. for a time of from one minute to 100 hours, to precipitate an omega phase;

wherein the Ti—Mo alloy so produced has a beta phase, an aged omega phase, and no alpha phase, and a swirly segregation portion having a width of 10 to 20 μm, and the aged omega phase is precipitated along the segregation portion in a plane of a back-scattered electron image (BEI) or an energy dispersive X-ray spectroscopy (EDS) image of the Ti—Mo alloy, as examined under a scanning microscope when measured in a plane perpendicular to a rolling direction, in which the Mo content is larger than the collective Mo content of the Ti—Mo alloy.

* * * * *